United States Patent [19]

Vittert

[11] 3,991,728

[45] Nov. 16, 1976

[54] ROTARY ENGINE

[76] Inventor: Murray B. Vittert, 10317 Sannois, St. Louis County, Mo. 63141

[22] Filed: May 10, 1974

[21] Appl. No.: 468,752

[52] U.S. Cl. ..... 123/44 D

[51] Int. Cl.[2] ..... F02B 57/00

[58] Field of Search ..... 123/44 D, 44 C; 417/462

[56] References Cited

UNITED STATES PATENTS

| | | | |
|---|---|---|---|
| 1,184,651 | 5/1916 | Johnston | 123/44 D |
| 1,282,429 | 10/1918 | Jones | 123/44 D |
| 1,918,174 | 7/1933 | Berggre | 123/44 D |
| 2,189,728 | 2/1940 | Daniels | 123/44 D |
| 3,799,035 | 3/1974 | Lamm | 123/44 D |

FOREIGN PATENTS OR APPLICATIONS

| | | | |
|---|---|---|---|
| 1,353,731 | 1/1964 | France | 123/44 D |

*Primary Examiner*—C. J. Husar
*Attorney, Agent, or Firm*—Ralph W. Kalish

[57] ABSTRACT

A rotary engine which comprises a cylindrical casing having an annular rotor disposed therein, the casing adjacent face of said rotor cooperating with recesses formed in the face of said casing to define a fuel admission chamber and a planarwise aligned fuel compression chamber, as well as an offset exhaust chamber. A pair of piston-receiving cylindrical chambers are formed in said rotor and with said pistons being engaged to connecting rods for securement to a shaft axially normal to said casing but eccentric thereof. One of said cylindrical chambers being adapted to communicate with said fuel admission and fuel compression chambers successively upon each rotation of said shaft and said other cylindrical chamber being simultaneously successively connected with an extension of said fuel compression chamber; a fuel igniter, and said exhaust chamber.

13 Claims, 15 Drawing Figures

ROTARY ENGINE

BACKGROUND AND SUMMARY OF THE INVENTION

This invention relates in general to internal combustion engines and, more particularly, to a rotary engine.

It is an object of the present invention to provide an internal combustion engine of the rotary type which is of markedly simple design having a paucity of movable elements so as to be resistant to breakdown.

It is another object of the present invention to provide an internal combustion engine of the rotary type wherein the normal strokes effected in a four-cycle engine are completed within a single rotation of the engine rotor thereby conducting to efficient operation and enhancing the durability of the engine components.

It is another object of the present invention to provide an internal combustion engine of the rotary type wherein a pair of pistons in diametrally opposed relationship perform specific distinct functions.

It is a still further object of the present invention to provide an internal combustion engine of the type stated which uniquely incorporates fuel-receiving chambers which obviate the utilization of the customary inlet and exhaust valves thereby obviating the potential for valve sticking with attendant difficulties.

It is another object of the present invention to provide an internal combustion engine of the type stated which may incorporate a plurality of pistons, each of which is adapted for effecting a power stroke and with such engine being supplied with precompressed fuel.

It is a further object of the present invention to provide an internal combustion engine of the type stated which permits of relatively high compression ratios so as to be useful with currently available fuels for providing requisite output; which is highly efficient and economical in operation; and which is especially adapted for utilization in multiple arrangements for meeting predetermined power output requirements.

DESCRIPTION OF PRACTICAL EMBODIMENTS

Figure 1:
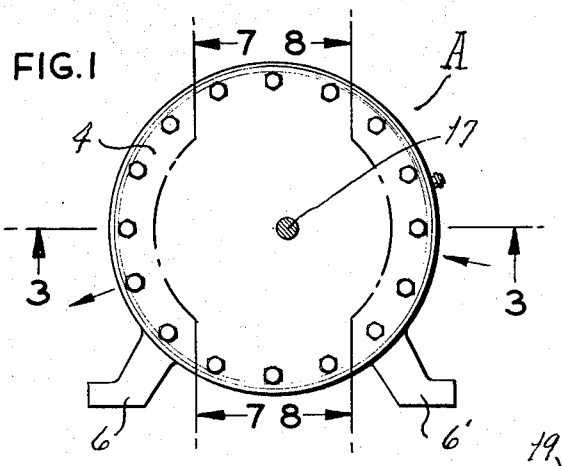
FIG. 1 is an end elevational view of a rotary engine constructed in accordance with and embodying the present invention.
Figure 2:
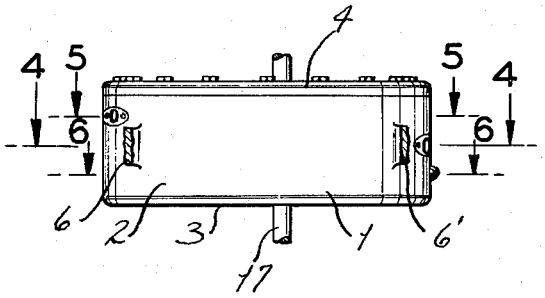
FIG. 2 is a bottom plan view.
Figure 3:
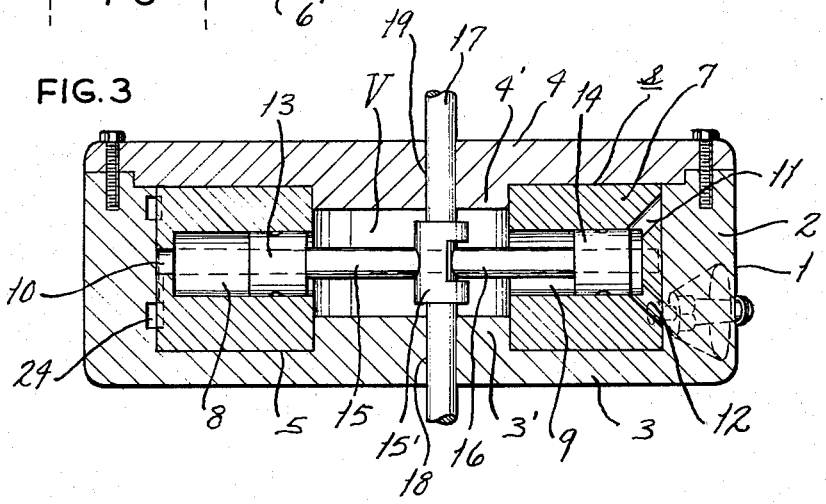
FIG. 3 is a horizontal transverse sectional view taken on the line 3—3 of FIG. 1.

Referring now by reference characters to the drawings which illustrate practical embodiments of the present invention, A generally designates an internal combustion, rotary engine comprising a cylindrical casing 1, having a continuous side wall 2, an integrally formed end wall 3, and a detachable closure plate 4 formed in the opposite end wall; which components cooperate to define an internal compartment 5. Extending from the under portion of side wall 2 may be opposed standards 6,6′. End wall 3 and closure plate 4 are centrally provided with inwardly projecting, annularly shaped, aligned bosses 3′,4′, which are of like diameter and on their confronting faces are spaced apart to provide a central volume V, and on their side faces cooperate with the inner face of casing side wall 2 to define an annular spacing *s* for receiving a complementarily contoured, annular rotor 7.

Rotor 7 is provided with a pair of diametrally opposed, cylindrically-formed chambers 8,9 which at their inner ends open into volume V. Chamber 8 at its opposite or outer end is continuous with a co-axial passage 10 of relatively reduced diameter which extends through the outer face of rotor 7; while chamber 9 in its outer end portion communicates with a pair of diverging passages 11,12, the axes of which are each at an angle of less than 90° with the projection of the axis of chamber 9, whereby said passage 11 is generally directed toward closure plate 4, while passage 12 is generally directed toward side wall 3. Provided within each chamber 8,9 for axially reciprocally slidable movement therein is a piston 13,14, respectively; each being conventionally engaged upon the outer end of connecting rods 15,16, respectively, which latter project through the inner open ends of the related chambers 8,9 for securement to a drive shaft 17 within volume V. Connecting rod 16 is rigidly fixed to shaft 17, being axially normal thereto, while connecting rod 15 is engaged as by a sleeve 15′ to permit of swingable movement of said rod with respect to shaft 17 in a plane normal to the axis thereof. Drive shaft 17 is journalled in aligned bearings 18,19 formed in bosses 3′,4′, respectively, which bearings are on an axis eccentric of said bosses 3′,4′ and, hence, of casing 1. It is, of course, understood that drive shaft 17 externally of casing 1 may be continuous or engaged to cooperating shafts for reception within companion engines should the same be arranged in a bank or otherwise.

Figure 4:
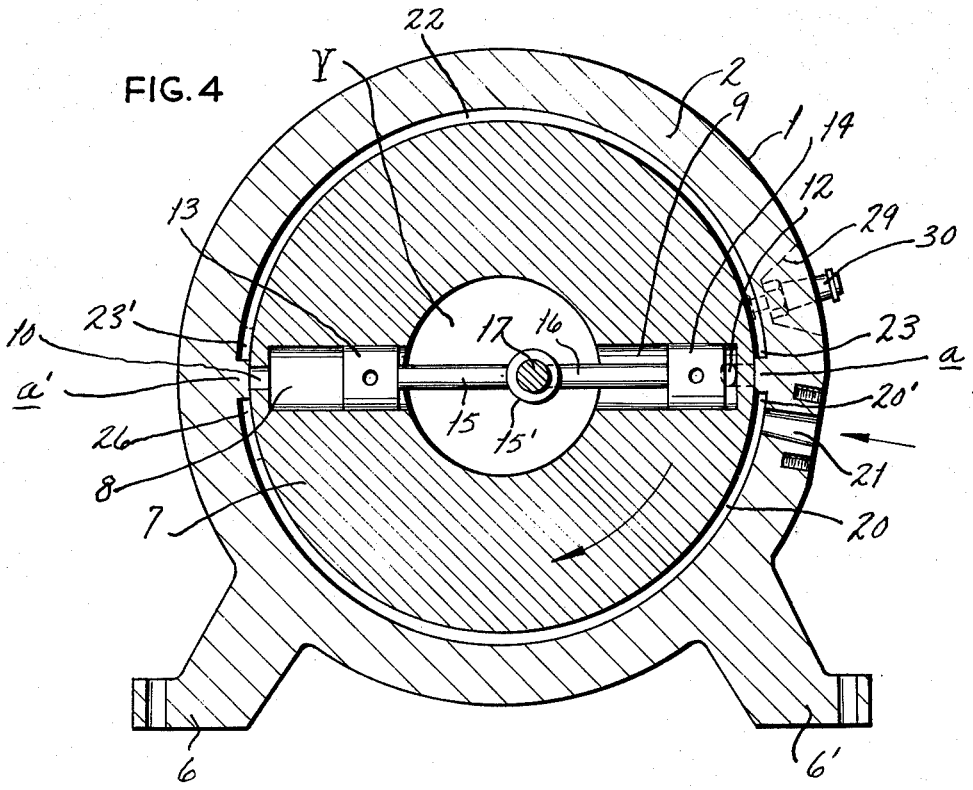
FIG. 4 is a vertical transverse sectional view taken on line 4—4 of FIG. 2.
Figure 5:
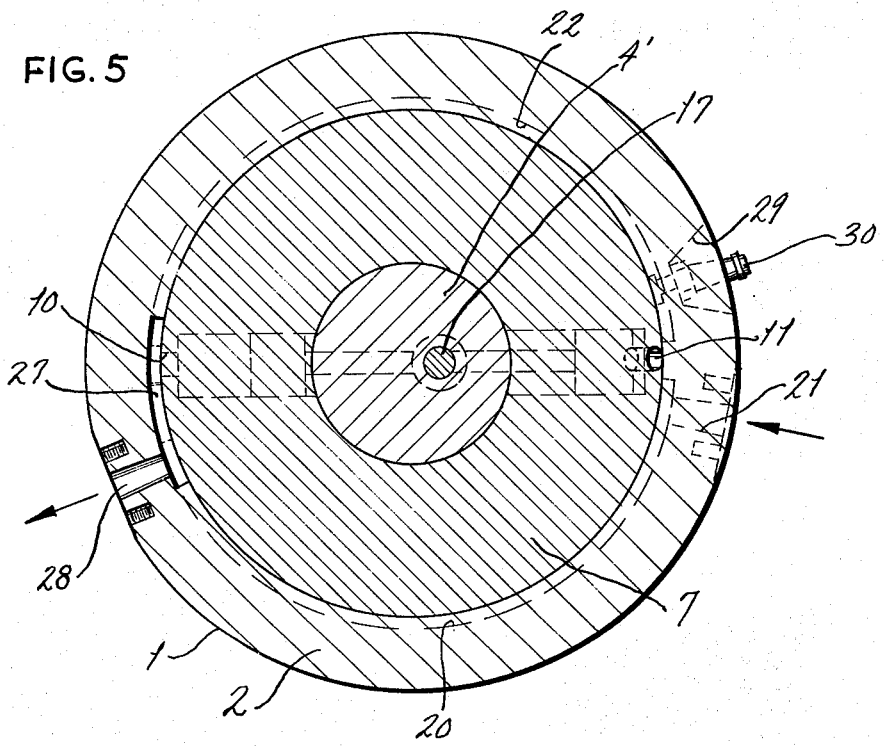
FIG. 5 is a vertical transverse sectional view taken on the line 5—5 of FIG. 2.
Figure 6:
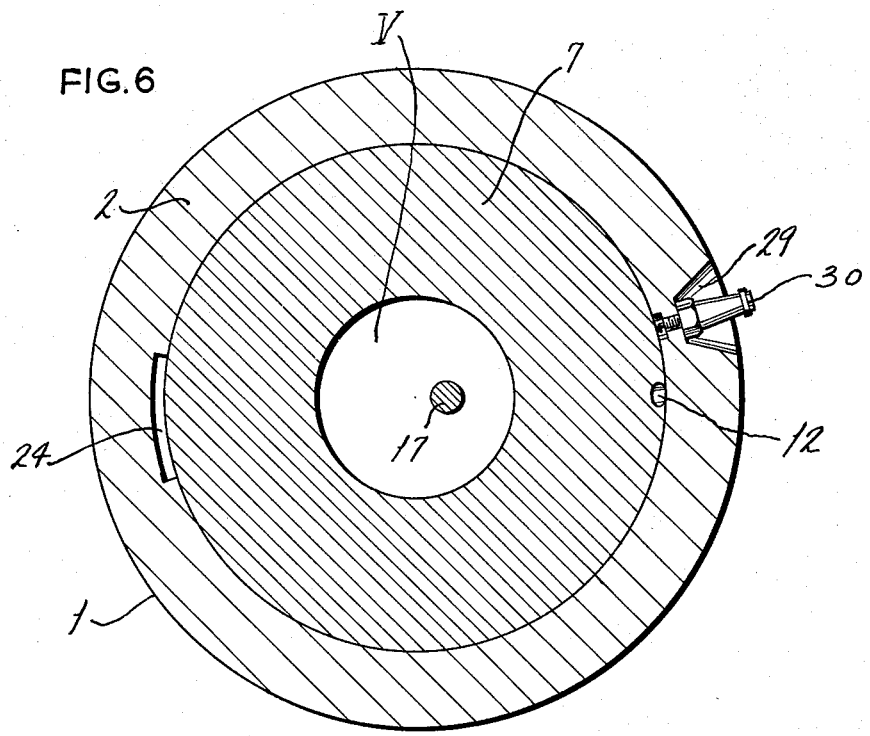
FIG. 6 is a vertical transverse sectional view taken on the line 6—6 of FIG. 2.
Figure 7:
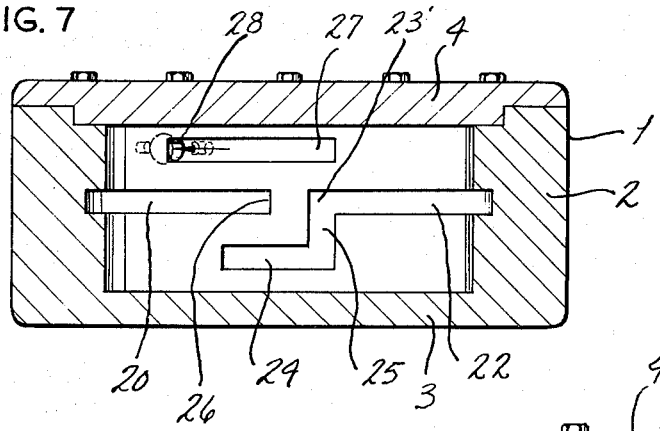
FIG. 7 is a vertical transverse sectional view taken on the line 7—7 of FIG. 1 turned through an angle of 90°.
Figure 8:
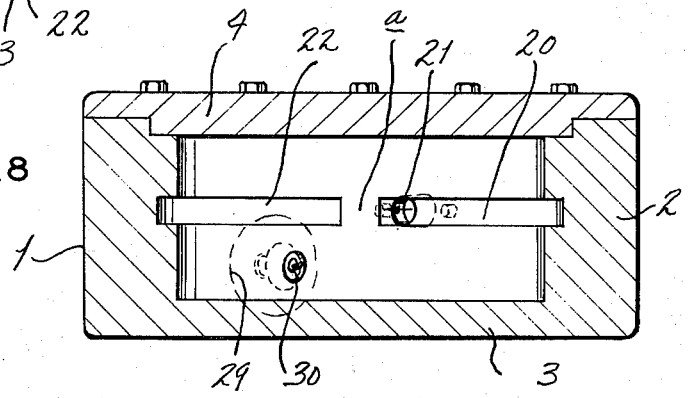
FIG. 8 is a vertical transverse sectional view taken on the line 8—8 of FIG. 1 turned through an angle of 90°.
Figure 9:
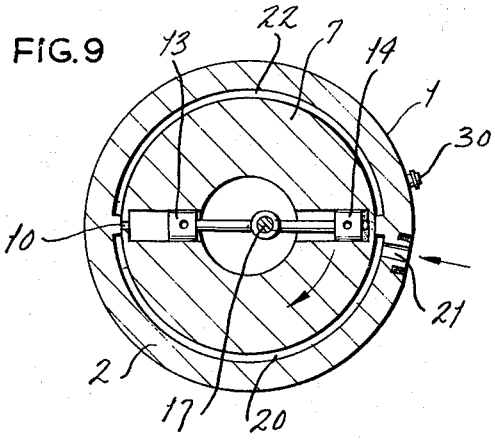
FIGS. 9, 10, 11, and 12 are vertical transverse sectional views each taken substantially on the line 4—4 of FIG. 2 but illustrating successive stages in the operation of the engine.

Formed substantially centrally on the inner face of side wall 2, and extending through slightly less than the bottom one-half thereof, as viewed in FIG. 4, is a relatively narrow, fuel admission chamber 20 which would normally open inwardly, but with the inner boundary thereof being constituted of the particular confronting portion of the outer face of rotor 7. At its inner end 20′, as viewed at the right hand side of FIG. 4, fuel admission chamber 20 communicates with a fuel inlet port 21 opening through side wall 2 for connection to a fuel source, such as, for example, the customary air-fuel mixture fed from a carburetor, or the like (not shown). Formed also on the inner face of side wall 2 of casing 1 in co-planar relationship with chamber 20 and in opposed disposition thereto for extension through slightly less than the upper half of side wall 2, is a fuel compression chamber 22 spaced at its inner and outer ends 23, 23', respectively, from the proximate ends of fuel admission chamber 20 by short wall portions, at *a*, *a'*. However, at its outer end 23' said compression chamber 22 is connected to a laterally offset chamber extension 24 by means of a short transverse conduit 25. Said extension chamber 24 terminates slightly beyond the proximate, outer end 26 of chamber 20 so as to, in effect, limitedly overlap same though being laterally spaced therefrom. The inner boundary of fuel compression chamber 22 together with chamber extension 24 is similarly defined by the particular confronting outer edge portion of rotor 7. There is additionally provided on the inner face of casing side wall 2 on the side of chambers 20,22 opposite to that adjacent chamber extension 24, a relatively short fuel exhaust chamber 27 of sufficient length to overlap partially the outer end portions 23', 26, of chambers 20,22, respectively; and being of greater length than chamber extension 24 for continuation beyond the end thereof proximate fuel admission chamber 20. At its end remote from fuel compression chamber 22, fuel exhaust chamber 27 communicates with the casing exterior by means of an exhaust or outlet port 28 progressing through side wall 2. Fuel compression chamber extension 24 and fuel exhaust chamber 27 are spaced from the plane of chambers 20,22 for registration with rotor passages 12,11, respectively, as will be discussed hereinbelow.

Casing side wall 2 also contains a contoured, through socket 29 receiving a spark plug 30, the electrodes of which are effectively exposed on the inner face of said side wall 2 for registration with passage 12 of rotor 7 for purposes presently appearing.

In operation, it will be seen that upon a single rotation of rotor 7, cylindrical chamber 8, through coaxial port 10, will alternatingly, progressively communicate with fuel admission chamber 20 and fuel compression chamber 22 throughout their respective extents; while the opposed cylindrical chamber 9 through passages 11,12 upon each such rotor rotation, will connect with exhaust chamber 27 and fuel compression chamber extension 24, respectively, and with said passage 12 also being brought into alignment with the electrodes of spark plug 30. Accordingly, it should be observed that pistons 13,14 perform distinct functions which conjointly produce the operation of machine A.

The appropriate fuel, such as an air-fuel mixture, is sucked through inlet port 21 for reception within fuel admission chamber 20. The initial rotation of drive shaft 17 being effected, as by a conventional electric motor, to cause rotor 7 to rotate and in a clockwise direction as viewed in FIG. 4, piston 13 is drawn inwardly within its cylindrical chamber 8 as the latter travels from the inner end 20' to the outer end 26 of said fuel admission chamber 20 thereby sucking the air-fuel mixture through said port 10 and into said chamber 8. As the clockwise rotation of rotor 7 continues, with port 10 moving past the outer end 26 of chamber 20, piston 13 will be caused to slide radially outwardly within said chamber 8 thereby compressing the air-fuel mixture and forcing same into fuel compression chamber 22. Thus, with each rotor rotation the operation of piston 13 is repeated, that is, with fresh fuel-air mixture sucked into cylindrical chamber 8 from chamber 20 and then being discharged through said port 10 and into chamber 22 in compressed state. Any residual compressed fuel which may remain within cylindrical chamber 8 subsequent to the movement of the same beyond the inner end 23 thereof will be intermixed with the freshly received fuel from fuel admission chamber 20. Consequently, piston 13 may be considered as a compressing piston since its function is to suck the fuel in and then to compress same.

Concurrently, with piston 14 drawn radially inwardly, with pressure reduction, cylindrical chamber 9 receives the compressed fuel from extension chamber 24 through passage 12 as the same moves communicatingly relatively along said chamber extension 24. As rotor 7 continues in its clockwise movement, piston 14 is being slidingly moved radially outwardly within cylindrical chamber 9 causing a compression of the charge accepted from extension chamber 24 so that when passage 12 is aligned with the electrodes of spark plug 30, ignition will occur with combustion of the charge. The gases of combustion will expand forcing pistion 14 radially inwardly providing the power for causing rotation of drive shaft 17 and hence of rotor 7. As the rotational cycle nears completion, passage 11 will register with exhaust chamber 27 in advance of passage 12 registering with extension chamber 24 to permit the exhaust gases to commence escape and with the removal of the same being facilitated by the force of the compressed fuel as the same enters cylindrical chamber 9 from chamber extension 14 through passage 12 as the same comes into registration. From the foregoing, piston 14 may be viewed as the power piston.

Figure 10:
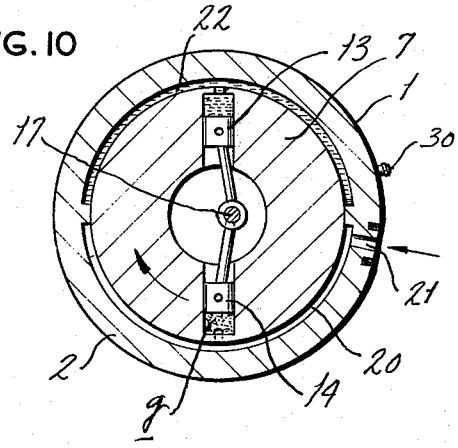
Figure 11:
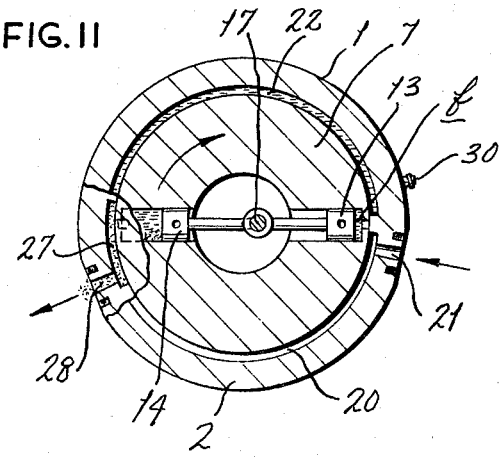
Figure 12:
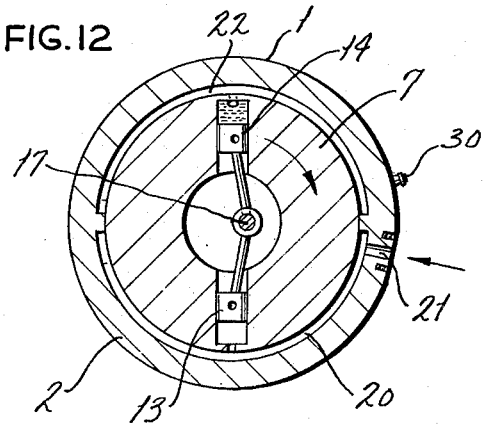

FIGS. 9–12, inclusive, illustrate the sequence of operation of engine A, permitting of simultaneous consideration of the movements of pistons 13,14; said Figures showing the said piston after 90° increments of movement. Thus, in FIG. 9, ignition by sparking at the electrodes of spark plug 30 has just occurred in cylindrical chamber 9, while cylindrical chamber 8 having received its supply of fuel from fuel admission chamber 20 is intermediate said chamber and fuel compression chamber 22. FIG. 10 shows the expansion of the gases of combustion, indicated at *g*, within cylindrical chamber 9 forcing piston 14 inwardly; while piston 13 is substantially intermediate its fuel compressing action with respect to chamber 22. FIG. 11 illustrates the exhausting of the spent gases through passage 11 and exhaust chamber 27 and with the commencement of inflow of compressed fuel into said chamber 9 through passage 12 from chamber extension 24; while cylindrical chamber 8 is intermediate the inner ends 23,20' of chambers 22,20, respectively, but having a residual amount of compressed fuel, as at *f*. FIG. 12 shows cylindrical chamber 8 opening through passage 10 into fuel admission chamber 20 for sucking thereinto the fresh fuel, while the fuel is being compressed within cylindrical chamber 9.

Accordingly, said FIGS. 9–12, inclusive, depict a single revolution of rotor 7 during which the customary steps of charge admission, charge compression, charge ignition, charge combustion, gas expansion, and gas exhaust are accomplished. Rotor 7 is coupled to shaft 17 by means of said pistons 13,14 through their respective connection rods 15,16 so that rotor 7 turns concurrently with drive shaft 17.

From the foregoing it will be observed that the engine of the present invention is uniquely devoid of inlet and exhaust valves of the type normally associated with internal combustion engines so that "sticking" with associated difficulties is obviated. The novel relationship of rotor 7 with its components and the engine casing bring about a most efficient operation. Thus, engine A contains a minimum of movable elements so that the same is extremely durable and resistant to break down. Rotor 7 is so constructed as to present minimal resistance to rotation, yet cooperating with the inner face of side wall 2 for effectively providing snug boundaries for chambers 20,22, 25,27 and chamber extension 24 to prevent accidental fluid flow beyond the defined passageways.

Figure 13:
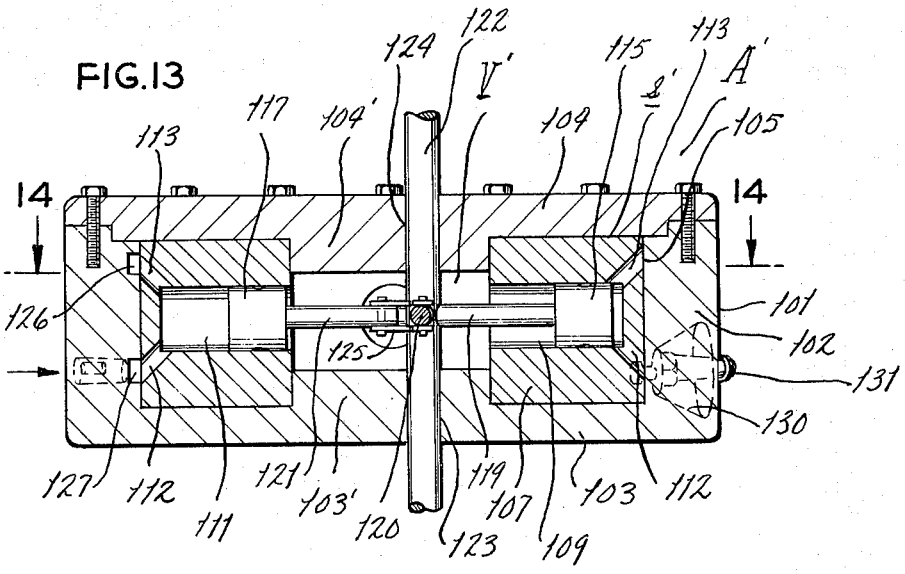
FIG. 13 is a horizontal transverse sectional view taken substantially on the line 3—3 of FIG. 1, but illustrating another form of rotary engine constructed in accordance with and embodying the present invention.
Figure 14:
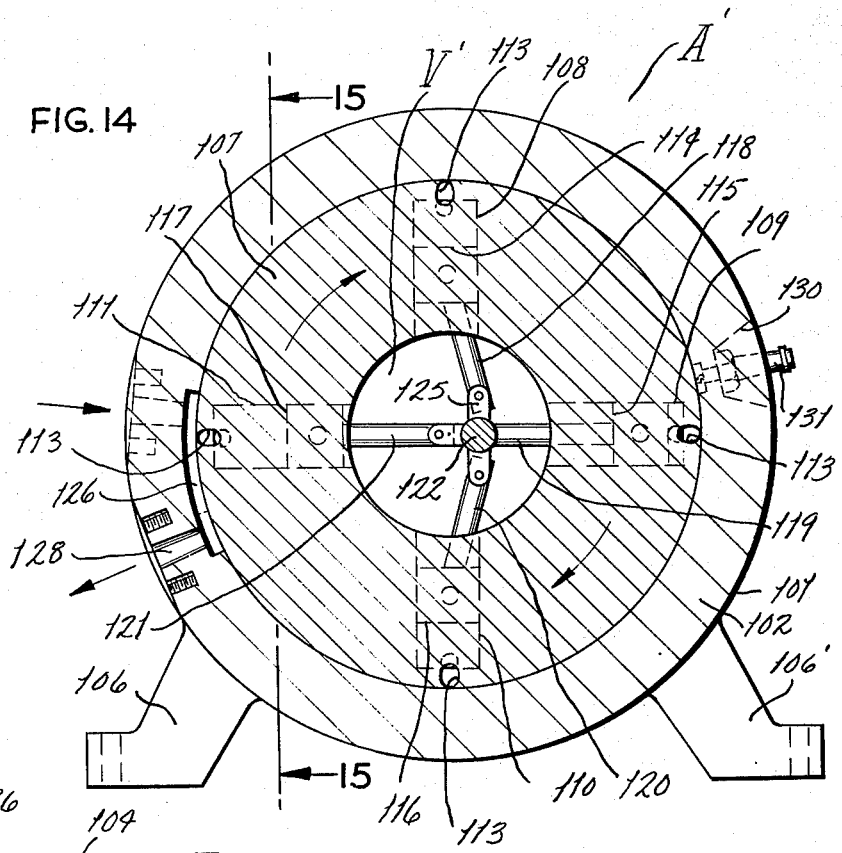
FIG. 14 is a vertical transverse sectional view taken on the line 14—14 of FIG. 13.
Figure 15:
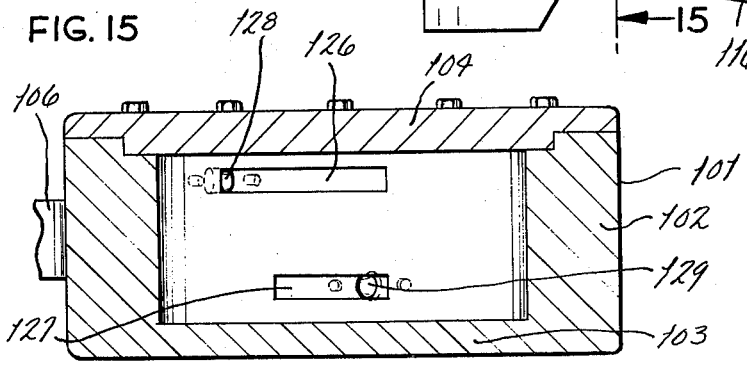
FIG. 15 is a vertical transverse sectional view taken on the line 15—15 of FIG. 14 but turned through an angle of 90°.

Referring now to FIGS. 13, 14 and 15, A′ designates another form of rotary engine which incorporates four pistons in lieu of the two pistons utilized in engine A hereabove described. Engine A′ comprises a cylindrical casing 101, having a continuous side wall 102, an integrally formed end wall 103, and a detachable closure plate 104 forming the opposite end wall; said components cooperating to define an internal compartment 105. Engine A′ may be supported by standards 106,106′ projecting from the under portion of side wall 102. End wall 103 and closure plate 104 are provided with inwardly projecting annularly shaped bosses 103′,104′, respectively, which are aligned, of like extent, and on their confronting faces are spaced apart to provide a volume V′. The side faces of said bosses 103′,104′ cooperate with the inner face of casing side wall 102 to define an annular spacing *s′* for receiving a complementarily contoured annular rotor 107. It will be seen that compartment 105 is comprised of volume V′ and spacing *s′*.

Rotor 107 is provided with four cylindrically formed chambers 108, 109, 110, 111, which are located at 90° intervals about said rotor and with the inner ends of said chambers opening into volume V′. At their outer ends, each of said chambers 108, 109, 110, 111 communicate with a pair of passages 112, 113 (see FIG. 13) which are in mutually diverging relationship; the axes of which are at an angle of less than 90° to a projection of the axis of the related chamber. Passages 112 are generally directed toward end wall 103 while passages 113 extend in the general direction of end plate 104.

Provided within chambers 108, 109, 110, 111 are axially reciprocally slideable pistons 114, 115, 116, 117, respectively, which are engaged in a conventional manner upon the outer ends of connecting rods 118, 119, 120, 121, respectively, which latter extend through the inner open ends of the related cylindrical chambers for connection to a drive shaft 122 extending transversely through volume V′. Said drive shaft 122 is journalled in aligned bearings 123,124 formed in bosses 103′, 104′, respectively. However, the aforesaid bearings are on an axis eccentric of casing 101 just as with respect to drive shaft 17 above discussed in conjunction with engine A. Connecting rod 119 is rigidly fixed to said drive shaft 122, while connecting rods 118,120 and 121 are secured to said drive shaft 122 for swingable movement as, for instance, by clevises 125.

Formed on the inner face of side wall 102 in one lateral portion thereof is a pair of circumferentially extending transversely spaced apart recesses 126,127 which constitute an exhaust chamber and a compressed fuel admission chamber respectively. The former, which is of greater length than the latter, is connected, at one of its ends, with the exterior of casing 101 through an outlet exhaust port 128 extending through side wall 102, while the latter communicates with the exterior of casing 101 by a fuel inlet port 129 opening through said side wall 102 and being at the end of chamber 127 opposite from that corresponding to the end of exhaust chamber 126 whereat exhaust port 128 is located. Thus, a predetermined circumferential spacing is provided between said ports 128,129. Said chambers 126,127 are transversely spaced apart a requisite distance so that the same are registrable with passages 112,113 of the aforesaid cylindrical chambers as rotor 107 is rotated.

Side wall 102 at a point substantially diametrally opposed to exhaust port 128, but substantially within the plane of chamber 127, contains a contoured through socket 130 for receiving a spark plug 131, the electrodes of which are exposed on the inner face of said side wall for registration with passages 112 of the cylindrical chambers 108, 109, 110, 111.

From the foregoing, the operation of engine A′ should be apparent since with rotor 107 moving through a single full rotation, in the direction indicated as by the arrows in FIG. 14, each of the said chambers 108, 109, 110, 111 will successively intercommunicate with fuel exhaust chamber 126 and fuel inlet chamber 127 so that the flow of exhaust gases from the particular cylindrical chamber will have commenced and be substantially completed as compressed fuel is forced into the particular chamber by flow through passage 112. The forceful introduction of such compressed fuel will also facilitate the removal of remaining exhaust gases as the related cylindrical chamber moves toward the port-remote end of said chamber. As the rotation of rotor 107 continues clockwise past fuel admission chamber 127, the associated piston will move slidingly radially outwardly effecting a compression of the fuel within such chamber so that when the related passage 112 is in registration with the electrodes of spark plug 131 ignition will occur with combustion of the charge. Thus, the particular piston under the expansion of the gases of combustion will be forced radially inwardly to provide power for rotation of drive shaft 122 with consequent rotation of rotor 107. By the time the particular cylindrical chamber has been returned to registration with fuel exhaust chamber 126 the respective piston will be in inwardly drawn position for facilitating the exhaust of the gases and the reception of the new compressed fuel charge.

Thus, with each rotation of rotor 107, four charges are fired which are productive of substantial power for generation of rotation of shaft 122. Although, conceivably, more than four pistons might be accommodated, it has been found in practice that the arrangement shown, that is, where in the pistons are located at 90° intervals, a most effective operation is achieved.

It is to be understood, of course, that fuel inlet port 129 is connected to any convenient source of compressed fuel such as, for instance, a turbo-charger, super-charger, or the like.

Having described my invention, what I claim and desire to obtain by Letters Patent is:

1. A rotary internal combustion engine comprising a casing having a cylindrical compartment, an annular rotor provided within said compartment in close fitting relationship with the inner face thereof but being relatively rotational therein, a drive shaft extending transversely through said casing and passing through said rotor, and being in normal relationship to the plane of rotation of said rotor, said drive shaft being eccentric with respect to the transverse axis of said casing, said rotor having first and second cylindrical chambers having axes radially of said rotor and each having inner and outer end portions, a fuel compression piston provided in said first cylindrical chamber, a power piston provided in said second cylindrical chamber, means connecting each piston through the inner end portion of the respective cylindrical chamber with said drive shaft, said casing having a fresh fuel admission chamber opening into said compartment, said casing having fuel inlet means connecting said fresh fuel admission chamber with the casing exterior, said casing having a fuel compression chamber opening into the interior of said compartment and being spaced from said fresh fuel admission chamber, said first cylindrical chamber having a passage for sequential communication with said fresh fuel admission chamber and said fuel compression chamber, means introducing compressed fuel from said fuel compression chamber into the outer end portion of said second cylindrical chamber, and means igniting the compressed fuel within said second cylindrical chamber.

2. A rotary internal combustion engine as defined in claim 1 and further characterized by said chambers being diametrally aligned.

3. A rotary internal combustion engine as defined in claim 2 and further characterized by said means connecting each piston with said drive shaft being connecting rods projecting through the inner portions of the respective cylindrical chambers.

4. A rotary internal combustion engine as defined in claim 1 and further characterized by said means for igniting the fuel being a spark plug fixed in said casing and having electrodes within said compartment.

5. A rotary internal combustion engine as defined in claim 4 and further characterized by said second cylindrical chamber second passage being registrable with said spark plug sequentially to connection with said fuel compression passage.

6. A rotary internal combustion engine as defined in claim 1 and further characterized by said fresh fuel admission chamber extending about said casing compartment through an angle greater than 90°.

7. A rotary internal combustion engine as defined in claim 1 and further characterized by said fresh fuel admission chamber and said fuel compression chamber being in opposed, coplanar relationship, the proximate ends of said fresh fuel admission chamber and said fuel compression chamber being spaced apart and separated by the intervening portion of said compartment so as to define distinct, discrete chambers.

8. A rotary internal combustion engine as defined in claim 7 and further characterized by said casing compartment having a fuel exhaust chamber located on one side of the plane defined by said fresh fuel admission chamber and said fuel compression chamber, there being a compressed fuel extension passage provided on the side of the aforesaid plane remote from that upon the said exhaust chamber is formed, said casing compartment also having a conduit opening interiorly of the said compartment and being between said fuel compression chamber and said fuel compression extension passage, said second cylindrical chamber having first and second passages for respective sequential communication with said fuel exhaust chamber and with said compressed fuel extension passage.

9. A rotary internal combustion engine as defined in claim 8 and further characterized by said drive shaft being eccentric with respect to the transverse axis of the compartment.

10. A rotary internal combustion engine as defined in claim 1 and further characterized by said fuel compression chamber extending about said compartment through an angle greater than 90°.

11. A rotary internal combustion engine comprising a casing having a cylindrical compartment, a rotor provided within said compartment for relative rotative movement therein, a drive shaft extending through said casing in normal relationship to the plane of rotation of said rotor, said rotor having four cylindrical chambers disposed at 90° intervals, each of said cylindrical chambers having inner portions and outer portions, a piston provided in each cylindrical chamber, means connecting each piston with said drive shaft, said casing compartment having a fresh fuel admission chamber opening interiorly thereof, said casing having fuel inlet means connecting said fresh fuel admission chamber with the casing exterior, said casing compartment having an exhaust chamber opening interiorly thereof, each of said cylindrical chambers having first and second passages in its outer portions for sequential communication with said fuel exhaust chamber and said fresh fuel admission chamber.

12. A rotary internal combustion engine as defined in claim 11 and further characterized by one of said pistons being fixedly connected with said drive shaft and the remaining pistons being swingably engaged to said drive shaft.

13. A rotary internal combustion engine as defined in claim 11 and further characterized by said fuel admission chamber and said exhaust chamber being in vertically spaced apart relationship.

* * * * *